US005992384A

United States Patent [19]

Bauer et al.

[11] Patent Number: 5,992,384

[45] Date of Patent: Nov. 30, 1999

[54] METHOD FOR ADJUSTING THE LOAD OF AN INTERNAL COMBUSTION ENGINE, IN PARTICULAR FOR A MOTOR VEHICLE

[75] Inventors: Bernhard Bauer, Regensburg; Michael Südholt, Köfering; Manfred Wier, Wenzenbach, all of Germany

[73] Assignee: Siemens Aktiegesellschaft, Munich, Germany

[21] Appl. No.: 09/070,405

[22] Filed: Apr. 30, 1998

Related U.S. Application Data

[63] Continuation of application No. PCT/DE96/01913, Oct. 4, 1996.

[51] Int. Cl.[6] ..... F02D 41/00

[52] U.S. Cl. ..... 123/399; 123/361; 123/480; 123/350

[58] Field of Search ..... 123/399, 361, 123/350, 352, 478, 480; 701/110

[56] References Cited

U.S. PATENT DOCUMENTS

| | | | |
|---|---|---|---|
| 4,332,226 | 6/1982 | Nomura et al. | 123/478 |
| 4,377,995 | 3/1983 | Fiala | 123/361 |
| 4,781,162 | 11/1988 | Ishikawa et al. | 123/399 |
| 5,517,410 | 5/1996 | Nakagawa et al. | 701/110 |
| 5,521,825 | 5/1996 | Unuvar et al. | 123/361 |
| 5,774,820 | 7/1998 | Linden et al. | 701/110 |

FOREIGN PATENT DOCUMENTS

| | | |
|---|---|---|
| 0344772A2 | 12/1989 | European Pat. Off. . |
| 0575635A1 | 12/1993 | European Pat. Off. . |
| 4223253A1 | 1/1994 | Germany . |
| 4239842A1 | 6/1994 | Germany . |

*Primary Examiner*—Willis R. Wolfe
*Assistant Examiner*—Hieu T. Vo
*Attorney, Agent, or Firm*—Herbert L. Lerner; Laurence A. Greenberg

[57] ABSTRACT

Pulsations which falsify an output signal of an air mass meter occur at low and medium rotational speeds in a unit that supplies air to an internal combustion engine. A method for adjusting the load of the internal combustion engine limits an opening angle of an electromotively adjustable throttle valve to a rotational speed-dependent opening value which includes an opening base value that is between a lower and an upper limit value. In the case of the lower limit value, the full load of the engine is reached. In the case of the upper limit value, pulsations of the air in an intake duct upstream of the throttle valve do not yet occur.

9 Claims, 5 Drawing Sheets

METHOD FOR ADJUSTING THE LOAD OF AN INTERNAL COMBUSTION ENGINE, IN PARTICULAR FOR A MOTOR VEHICLE

CROSS-REFERENCE TO RELATED APPLICATION

This application is a continuation of International Application No. PCT/DE96/01913, filed Oct. 4, 1996, which designated the United States.

BACKGROUND OF THE INVENTION

FIELD OF THE INVENTION

The invention relates to a method for adjusting the load of an internal combustion engine, in particular for a motor vehicle, in which an opening angle of an electromotively adjustable throttle valve in an intake duct is derived from a position of an accelerator pedal, and the opening angle is limited to a rotational speed-dependent opening value.

The invention is based on a throttle valve controller in accordance with German Published, Non-Prosecuted Patent Application DE 42 23 253 A1. In that publication, a control unit (electronic engine power controller) is described which forms a setpoint value for the opening angle of the throttle valve, at least as a position of the accelerator pedal. The value serves as a reference variable for a position controller which actuates an electromotive actuator for setting the opening angle of the throttle valve.

In order to condition a mixture correctly, fuel-metering systems require precise information on the air mass sucked in per stroke by the internal combustion engine. They receive that information through a quick-reacting air mass sensor which operates, for example, according to the hot film principle. Due to its high response speed, the output signal of the air mass sensor follows each pulsation in the air stream. Even air masses which are flowing back are sensed, but with a negative sign.

Alternating forward flows and backward flows of the air in an intake duct of an internal combustion engine are referred to as pulsations.

As soon as such pulsations occur, the air mass sensor therefore no longer supplies any correct measured values which could be used for conditioning the mixture.

A method for reducing the pulsations in the region of the intake duct in which the air mass sensor is disposed is known from German Published, Non-Prosecuted Patent Application DE 42 39 842 A1. That method is based on the discovery that the backward flow has a fixed chronological relationship with the position of the crankshaft. Thus, the frequency of the backward flow of the air masses corresponds to the rotational speed of the internal combustion engine. In that method, the opening angle of the throttle valve is changed at every reversal in flow. Thus, it moves in the direction of "closing" in the case of backward flowing air masses and in the direction of "opening" in the case of forward flowing air masses.

The backward flow in the region of the intake tract which lies upstream of the throttle valve is thus damped. The disadvantage of that method is the very high actuation expenditure for the adjustment of the throttle valve directed counter to the backward flowing air masses.

In a system known from U.S. Pat. No. 4,781,162 for controlling the throttle valve of an internal combustion engine, a maximum opening angle is determined as a function of the rotational speed. The opening angle of the throttle valve is regulated so as to achieve minimum fuel consumption with the stipulation that the maximum opening angle is not exceeded. Abrupt changes in the power emission of the internal combustion engine are thus prevented.

SUMMARY OF THE INVENTION

It is accordingly an object of the invention to provide a method for adjusting the load of an internal combustion engine, in particular for a motor vehicle, which overcomes the hereinafore-mentioned disadvantages of the heretofore-known methods of this general type, which is simple and which makes it possible to prevent pulsations from occurring upstream of a throttle valve in an intake duct of an internal combustion engine.

With the foregoing and other objects in view there is provided, in accordance with the invention, a method for adjusting the load of an internal combustion engine, in particular for a motor vehicle, which comprises deriving an opening angle of an electromotively adjustable throttle valve in an intake duct from a position of an accelerator pedal; and limiting the opening angle to a rotational speed-dependent opening value including an opening base value between a lower limit value (full-load value) at which a full engine load is reached, and an upper limit value (pulsation value) at which pulsations of air in the intake duct upstream of the throttle value do not yet occur.

In accordance with another mode of the invention, there is provided a method which comprises obtaining the opening value from an additive correction of the opening base value with a first correction value dependent on temperature in the intake duct of an internal combustion engine and ambient pressure.

In accordance with a further mode of the invention, there is provided a method which comprises obtaining the opening value from an additive correction of the opening base value with a second correction value dependent on rotational speed and adapted to ensure that pulsations of the air in the intake duct do not yet occur at the opening angle of the throttle valve corresponding to the opening value.

In accordance with an added mode of the invention, there is provided a method which comprises making the opening base value additionally dependent on an effective length of the intake duct.

In accordance with an additional mode of the invention, there is provided a method which comprises making the opening base value additionally dependent on a valve control time of inlet valves.

In accordance with yet another mode of the invention, there is provided a method which comprises making the second correction value additionally dependent on an effective length of the intake duct.

In accordance with a concomitant mode of the invention, there is provided a method which comprises making the second correction value additionally dependent on a valve control time of inlet valves.

Other features which are considered as characteristic for the invention are set forth in the appended claims.

Although the invention is illustrated and described herein as embodied in a method for adjusting the load of an internal combustion engine, in particular for a motor vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
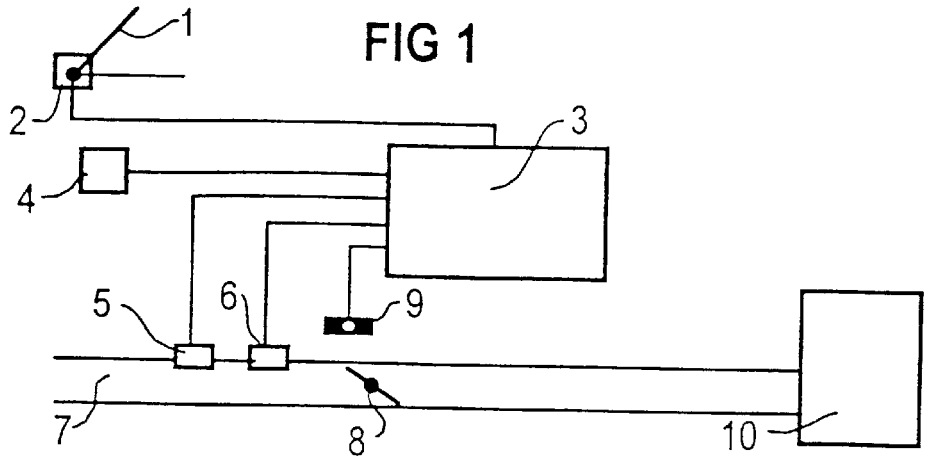
FIG. 1 is a schematic and block circuit diagram of a configuration in which the method according to the invention is used.

Referring now to the figures of the drawings in detail and first, particularly, to FIG. 1 thereof, there is seen an engine control system which has an accelerator pedal 1 with a signal transmitter 2 that senses a position of the accelerator pedal 1. The signal transmitter 2 is electrically conductively connected to a control unit 3. The control unit 3 senses ambient pressure through a pressure sensor 4 or derives it from secondary variables.

A temperature sensor 5 and an air mass sensor 6 are disposed in an intake duct or tube 7 and are electrically conductively connected to the control unit 3. The temperature sensor 5 senses the temperature of the air in the intake duct 7. The air mass sensor 6 senses the intake air mass.

A throttle valve 8 is disposed in the intake duct 7 downstream of the air mass sensor 6. The throttle valve 8 can be adjusted through the use of an electromotive drive 9. The intake duct 7 is connected to an internal combustion engine 10.

Figure 2:
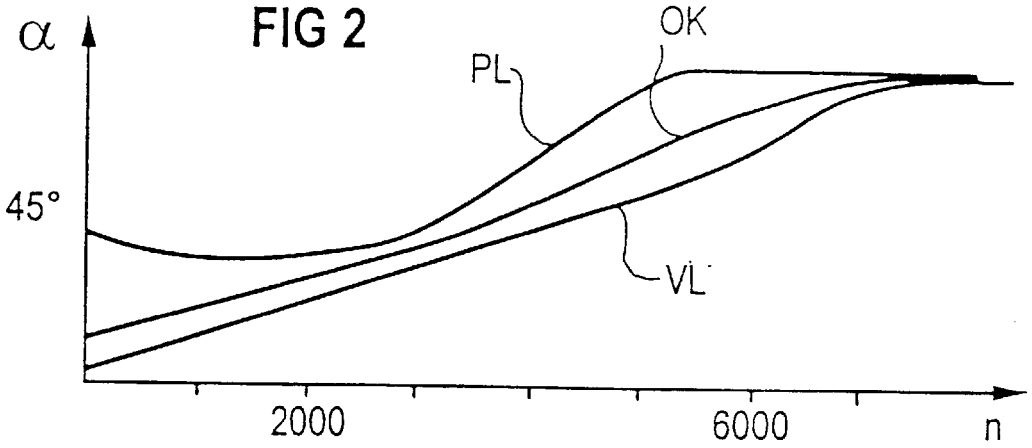
FIG. 2 is a graph showing an exemplary profile of an opening characteristic curve.

FIG. 2 shows a full-load curve VL with full-load values of an opening angle of the throttle valve 8 as a function of a rotational speed n. A maximum charge (referred to below as full engine load) of the cylinders of the internal combustion engine 10 is reached at every full load value. Given a uniform rotational speed n, the charge of the cylinders thus no longer increases as a result of the opening angle of the throttle valve 8 becoming larger.

At low rotational speeds n, the full load of the engine is already reached at small opening angles of the throttle valve 8. The full-load curve VL rises approximately linearly with the rotational speed n until, at high rotational speeds n, it reaches the value of the maximum opening angle of the throttle valve 8.

At a specific rotational speed n, pulsations cannot occur until the opening angle of the throttle valve 8 is larger than a pulsation value. These pulsation values, which are applied as a function of the rotational speed n, result in a pulsation curve PL.

Pulsations occur at low to medium rotational speeds n. They are particularly pronounced in internal combustion engines 10 with up to four cylinders. FIG. 2 clearly shows that at any rotation speed n the pulsation value is larger than the full-load value or equal to the full-load value if the full-load value has the value of the maximum opening angle of the throttle valve.

The method according to the invention is based on an opening characteristic curve OK which is positioned between the full-load curve VL and the pulsation curve PL and from which it is possible to determine an opening base value OBW for each rotational speed n which is between the associated full-load value on the full-load curve VL and the pulsation value that is on the pulsation curve PL and is associated with this rotational speed. The full-load curve VL, the pulsation curve PL and the opening characteristic curve OK apply to a set temperature of the air in the intake duct 7 (for example 20° C.) and to a set pressure of the ambient pressure (for example 1000 mbar). If the temperature and/or the ambient pressure deviate from these set values, corresponding correction is necessary.

The opening angle of the electromotively operated throttle valve 8 is limited to a rotational speed-dependent opening value OW which corresponds to the opening base value OBW for these set values.

Figure 3:
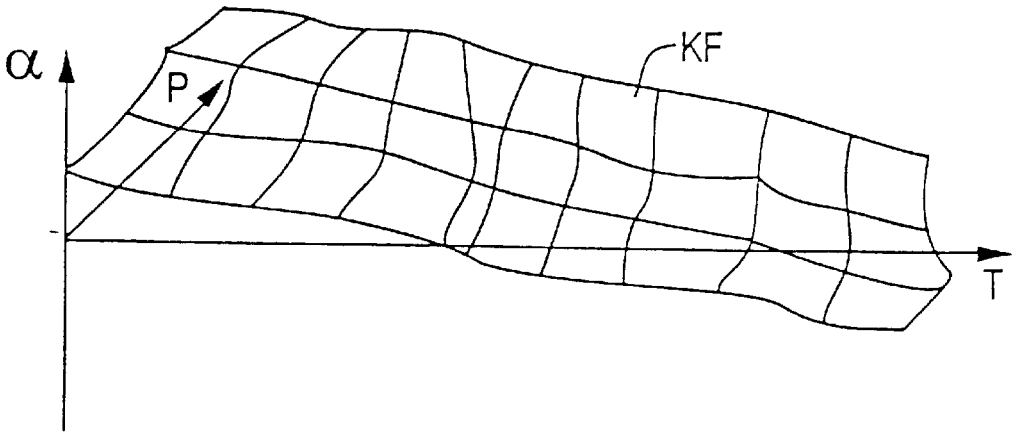
FIG. 3 is a graph showing an exemplary characteristic diagram.

A first correction value KW1 is determined from a characteristic diagram KF shown in FIG. 3, as a function of the temperature and the ambient pressure. The opening value OW is adapted to the ambient pressure and the temperature in the respective operating state of the internal combustion engine 10 by using the first correction value KW1. The first correction value KW1 has the value zero at the set temperature and the set pressure. A higher ambient pressure than the set pressure brings about a reduction in the first correction value KW1, and an increase in the temperature in contrast to the set temperature causes the first correction value KW1 to become larger.

Figure 4:
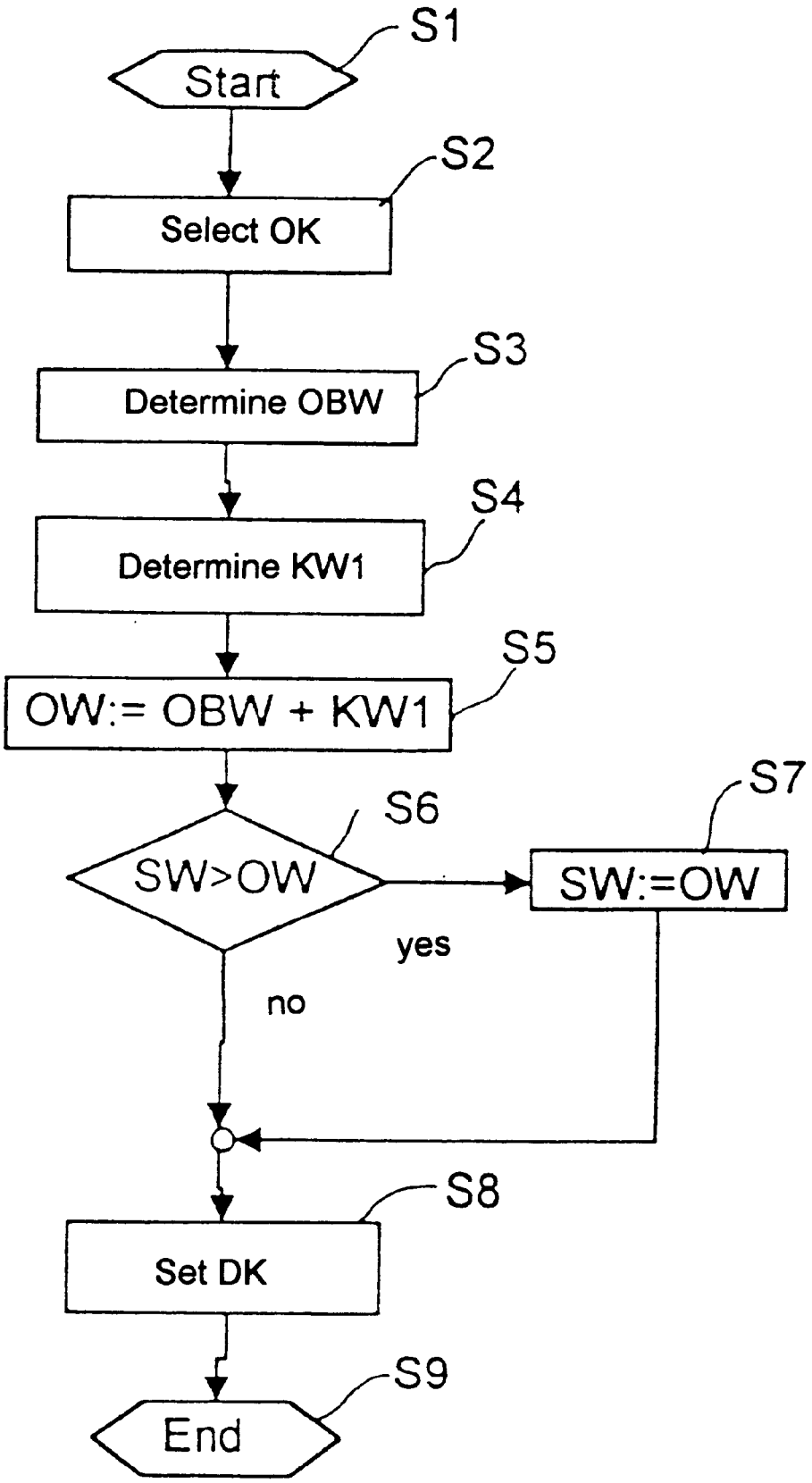
FIG. 4 is a first flowchart of the method according to the invention.

The method according to the invention, which is illustrated in FIG. 4, is started in a step S1. The opening characteristic curve OK is selected in a step S2. If the engine control system has an intake duct 7 with a variable effective length, or inlet valves with a variable valve control time, an opening characteristic curve OK is permanently stored for each effective length of the intake duct 7 and/or for each valve control time. A change in the opening time or the closing time of the inlet valves relative to the associated crankshaft angles is referred to as a variable valve control time. The variable valve control time can be obtained, for example, with a camshaft which has cams of a different construction or with electronically controlled inlet valves.

The opening base value OBW is determined in a step S3. The rotational speed n is sensed, for example, by a rotational speed sensor on the crankshaft. The associated opening base value OBW on the opening characteristic curve OK is then determined as a function of the rotational speed n.

In a step S4, the first correction value KW1 is determined from the characteristic diagram KF as a function of the temperature in the intake duct 7 and as a function of the ambient pressure.

Subsequently, in a step S5, a total formed from the opening base value OBW and the first correction value KW1 is assigned to the opening value OW.

In a step S6, checks are made as to whether or not a setpoint or desired value SW, which is formed as a function of the position of the accelerator pedal 1, is larger than the opening value OW. If this is the case, the system branches into a step S7. Otherwise, the system branches into a step S8. In the step S7, the opening angle OW is assigned to the setpoint value SW and the setpoint value SW is thus limited to the opening value OW.

In the step S8, the throttle valve 8, which is represented by reference symbol DK, is set to the opening angle which corresponds to the setpoint value SW. The setpoint value SW is used as a reference variable for a position controller which regulates the opening angle of the throttle valve 8. The method is terminated in a step S9.

Figure 5:
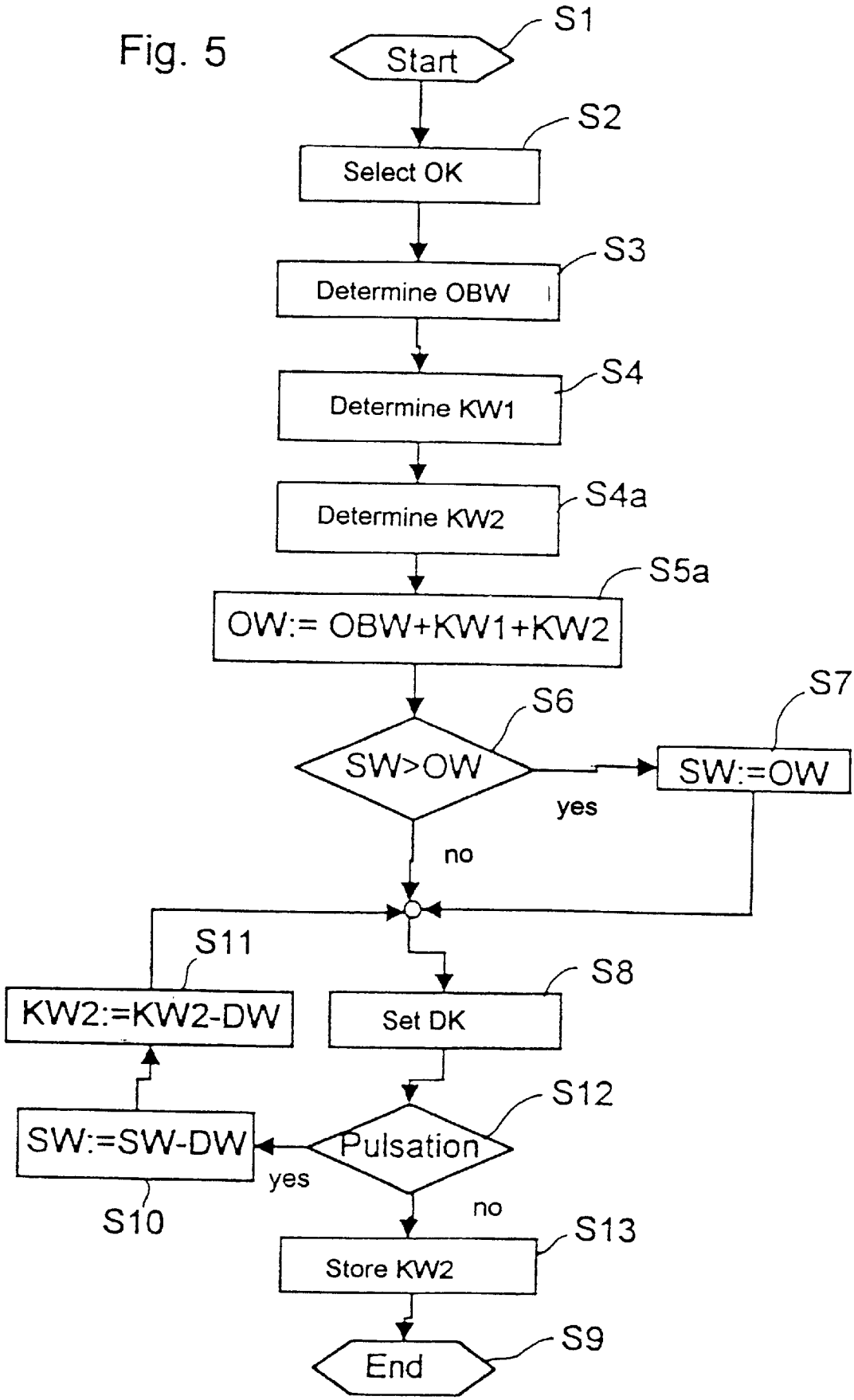
FIG. 5 is a second flowchart of the method according to the invention.

In FIG. 5, the method steps which are provided with the same reference symbols as in FIG. 4 are identical to those in FIG. 4. For this reason, they are not described further below.

In this embodiment of the method, the opening characteristic curve OK is configured in such a way that the opening base values OBW are only slightly below the associated pulsation values, in terms of absolute value.

After the step S4, the method is continued in a step S4*a*. There, a second correction value KW2 is determined from an adaptation table as a function of the rotational speed. The adaptation table is stored for each effective length of the intake duct 7 and for each valve control time in a memory and can be changed. Production tolerances and changes in the internal combustion engine 10 and in the intake duct 7 due to aging, which can result in the pulsation curve being displaced, are allowed for through the use of the second correction value KW2.

In a step S5*a*, a total formed from the opening base value OBW, the first correction value KW1 and the second correction value KW2 is assigned to the opening value OW.

The method step S8, in which the throttle valve 8 is set, is followed by a method step S12. There, checks are made as to whether or not there is a pulsation in the intake duct 7 upstream of the throttle valve 8. A known method, such as is disclosed, for example, in European Patent 0 575 635, is used for this purpose. Since this method is not essential to the invention, it is not described in more detail below.

If a pulsation is detected in the step S12, the system branches into a step S10. There, the setpoint value SW is assigned the old setpoint value SW reduced by a delta value DW. The delta value DW is a permanently prescribed positive value. In a step S11, the second correction value KW2 is reduced by the delta value DW. After the step S11, the method is continued again in the step S8.

If no pulsation is detected in the step S12, the system branches into a step S13 and the second control value KW2 is stored in that step. The adaptation table is thus adapted. The method is terminated in the step S9.

In this method, it is ensured that the second correction value KW2 is adapted in such a way that the opening angle which corresponds to the opening value OW is not present in the pulsation.

Figure 6A:
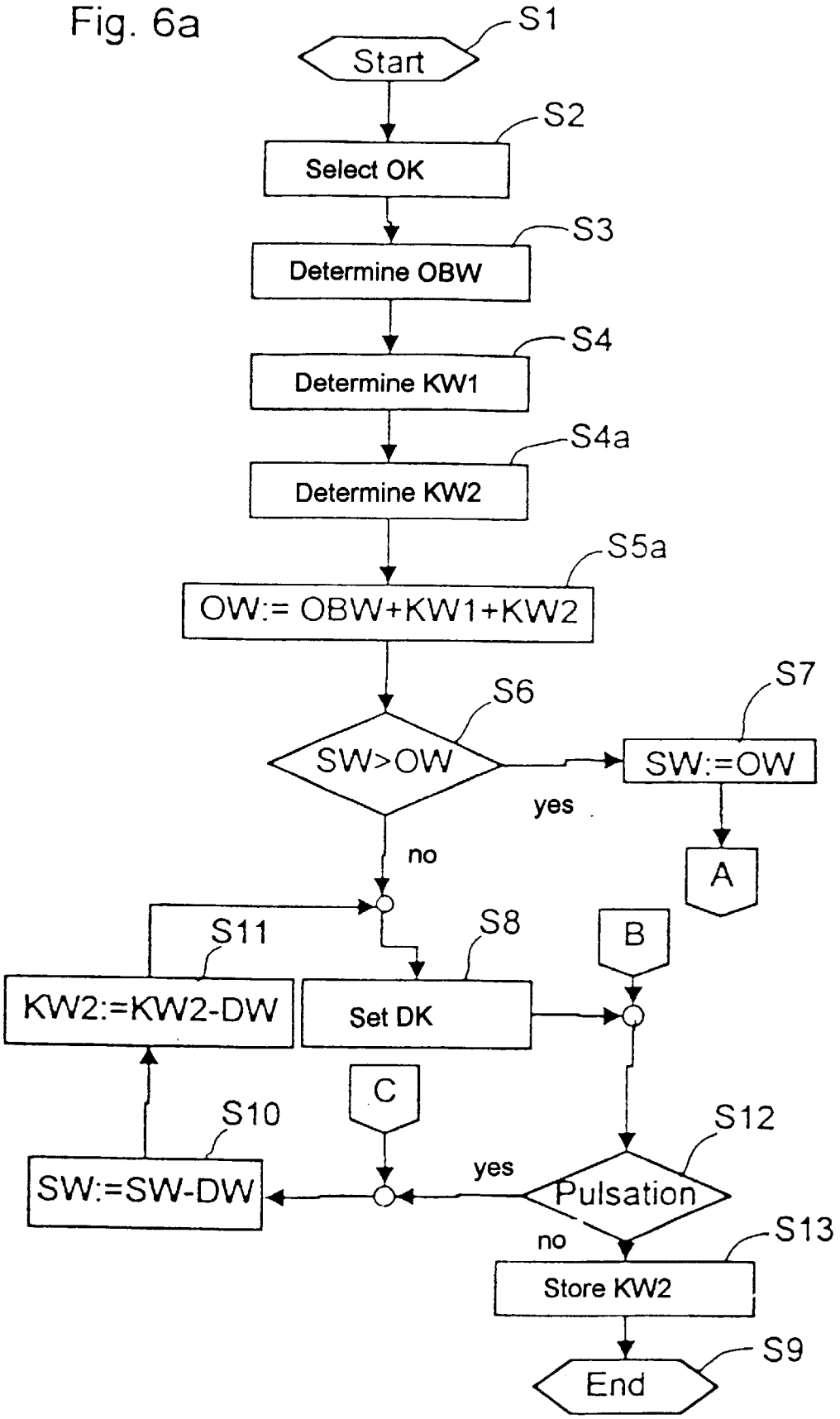
FIGS. 6*a* and 6*b* together are a third flowchart of the method according to the invention.
Figure 6B:
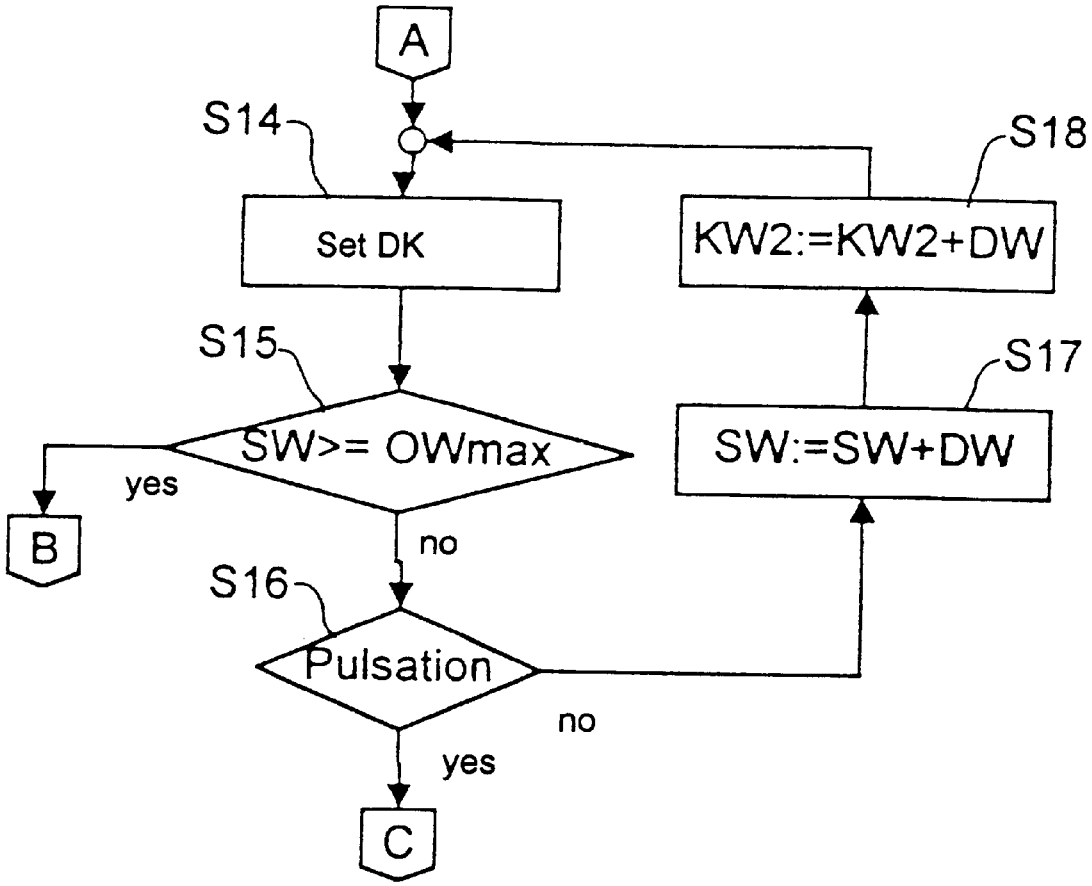

In FIGS. 6*a* and 6*b*, method steps which are provided with the same reference symbols as in FIG. 5 are identical to those from FIG. 5. For this reason, they are not described in more detail below.

In contrast to the embodiment of the method described in FIG. 5, the step S7 in FIG. 6*a* is followed by a step S14 in FIG. 6*b*, in which the throttle valve is set in a manner analogous to step S8.

In a step S15 checks are made as to whether or not the setpoint value SW is larger than or equal to a maximum opening value OWmax which corresponds to the maximum opening angle of the throttle valve. If this is the case, the system branches into step the S12, otherwise the system branches into a step S16.

In the step S16, in a manner analogous to the step S12, checks are made as to whether or not a pulsation is present upstream of the throttle valve 8 in the intake duct 7. If this is not the case, the system branches into a step S17 in which the setpoint value SW is increased by the delta value DW. Otherwise, the system branches into the step S10.

In a step S18, the second correction value KW2 is increased by the delta value DW. Then, the method is continued in the step S14.

In this embodiment of the method according to the invention, the second correction value is adapted in such a way that the opening angle which corresponds to the opening value OW is just below the opening angle of the throttle valve at which pulsations occur or at which the maximum opening angle is reached. An allowance can thus be made for production tolerances and changes due to aging.

We claim:

1. A method for adjusting the load of an internal combustion engine, which comprises:

deriving an opening angle of an electromotively adjustable throttle valve in an intake duct from a position of an accelerator pedal; and limiting the opening angle to a rotational speed-dependent opening value including an opening base value between a lower limit value at which a full engine load is reached, and an upper limit value at which pulsations of air in the intake duct upstream of the throttle value do not yet occur.

2. The method according to claim 1, which comprises obtaining the opening value from an additive correction of the opening base value with a correction value dependent on temperature in the intake duct of an internal combustion engine and ambient pressure.

3. The method according to claim 1, which comprises obtaining the opening value from an additive correction of the opening base value with a correction value dependent on rotational speed and adapted to ensure that pulsations of the air in the intake duct do not yet occur at the opening angle of the throttle valve corresponding to the opening value.

4. The method according to claim 1, which comprises making the opening base value additionally dependent on an effective length of the intake duct.

5. The method according to claim 1, which comprises making the opening base value additionally dependent on a valve control time of inlet valves.

6. The method according to claim 3, which comprises making the correction value additionally dependent on an effective length of the intake duct.

7. The method according to claim 3, which comprises making the correction value additionally dependent on a valve control time of inlet valves.

8. The method according to claim 1, which comprises adjusting the load of an internal combustion engine for a motor vehicle.

9. The method according to claim 1, which comprises defining the lower limit value as a full-load value, and defining the upper limit value as a pulsation value.

* * * * *

UNITED STATES PATENT AND TRADEMARK OFFICE

CERTIFICATE OF CORRECTION

PATENT NO :5,992,384

DATED :November 30, 1999

INVENTOR(S) :Bernhard Bauer et al.

It is certified that error appears in the above-identified patent and that said Letters Patent are hereby corrected as shown below:

Title page,
Item [30] should read as follows:

Oct. 30, 1995 [DE] Germany ..... 195 40 832.2

Signed and Sealed this

Twelfth Day of December, 2000

*Attest:*

*Attesting Officer*

Q. TODD DICKINSON

*Director of Patents and Trademarks*